US011631563B2

(12) United States Patent
Orban et al.

(10) Patent No.: US 11,631,563 B2
(45) Date of Patent: Apr. 18, 2023

(54) ELECTROMAGNETIC ACTUATOR, ELECTRICAL SWITCHING UNIT COMPRISING AN ELECTROMAGNETIC ACTUATOR OF THIS KIND

(71) Applicant: Schneider Electric Industries SAS, Rueil Malmaison (FR)

(72) Inventors: Remy Orban, Saint Martin d'Uriage (FR); Cédric Bricquet, Brie et Angonnes (FR); Régis Perrocheau, Laval (FR); Stéphane Follic, Lumbin (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 17/154,653

(22) Filed: Jan. 21, 2021

(65) Prior Publication Data

US 2021/0233730 A1 Jul. 29, 2021

(30) Foreign Application Priority Data

Jan. 24, 2020 (FR) ..... 2000703

(51) Int. Cl.
*H01H 50/42* (2006.01)
*H01H 50/18* (2006.01)

(52) U.S. Cl.
CPC ..... *H01H 50/42* (2013.01); *H01H 50/18* (2013.01)

(58) Field of Classification Search
CPC ..... H01H 50/42; H01H 50/18
USPC ..... 335/220, 224
See application file for complete search history.

(56) References Cited

U.S. PATENT DOCUMENTS

| | | | | |
|---|---|---|---|---|
| 8,193,887 | B2 * | 6/2012 | Sohn | H01F 7/1615 335/297 |
| 9,508,514 | B2 * | 11/2016 | Ohda | H01F 7/122 |
| 9,595,411 | B2 * | 3/2017 | Shimizu | H01H 50/44 |
| 9,733,292 | B2 | 8/2017 | Delbaere et al. | |
| 10,403,461 | B2 * | 9/2019 | Kobayashi | H01H 50/54 |
| 2003/0006870 | A1 * | 1/2003 | Ohya | H02K 33/16 335/220 |

(Continued)

FOREIGN PATENT DOCUMENTS

| | | | |
|---|---|---|---|
| DE | 102013007989 | A1 | 10/2014 |
| EP | 2469568 | A1 | 6/2012 |

(Continued)

OTHER PUBLICATIONS

French Search Report and Written Opinion dated Jun. 29, 2020 for corresponding French Patent Application No. FR2000703, 8 pages.

*Primary Examiner* — Alexander Talpalatski
(74) *Attorney, Agent, or Firm* — Locke Lord LLP

(57) ABSTRACT

An electromagnetic actuator has:
an armature carrying at least one coil;
a ferromagnetic yoke configured to channel a magnetic flux created by the coil; and
a ferromagnetic moving part that interacts with the yoke to form a magnetic circuit formed at least in part by an assembly of laminated metal plates, the moving part being configured to move in relation to the armature under the action of the magnetic field generated by the coil. The actuator moreover has an auxiliary magnetic circuit made of electrically conductive material, in order to permit the flow of currents induced in the auxiliary magnetic circuit when a magnetic field is generated by the coil.

15 Claims, 4 Drawing Sheets

(56) References Cited

U.S. PATENT DOCUMENTS

| | | | | |
|---|---|---|---|---|
| 2017/0110274 | A1* | 4/2017 | Hahn | H01F 7/1844 |
| 2021/0027964 | A1* | 1/2021 | Yamakawa | H01H 47/22 |

FOREIGN PATENT DOCUMENTS

| | | | |
|---|---|---|---|
| EP | 2779191 | A1 | 9/2014 |
| EP | 2584575 | B1 | 12/2016 |

* cited by examiner

ELECTROMAGNETIC ACTUATOR, ELECTRICAL SWITCHING UNIT COMPRISING AN ELECTROMAGNETIC ACTUATOR OF THIS KIND

TECHNICAL FIELD

The present invention relates to an electromagnetic actuator.

The invention also relates to an electrical switching unit having an actuator of this kind.

BACKGROUND

Electromagnetic actuators generally have a fixed armature carrying at least one coil able to generate a magnetic field, and a moving part that moves in translation under the action of the magnetic field generated by the coil, by virtue of a magnetic circuit that serves to channel the magnetic flux.

Actuators of this kind are often encountered in electrical switching units, such as contactors, or relays, or remote-controlled switches. The moving part is generally mechanically coupled to electrical contacts or to a switching mechanism in order to selectively open or close an electrical circuit.

Some diagnostic methods and devices have been developed in order to estimate the wear state and the operating state of actuators of this kind, as illustrated by patent application EP2584575B1.

Moreover, in order to improve the performance and/or reduce the manufacturing costs of these actuators, it is sometimes desirable to replace the ferromagnetic materials that are used with assemblies of laminated ferromagnetic plates.

One drawback is that, in this case, the electric currents induced by the magnetic field are no longer able to flow in the stacking direction of the plates, due to poor electrical conductivity at the interfaces between the plates.

The diagnostic methods outlined above therefore become impossible to implement.

There is therefore a need for an electromagnetic actuator that makes it possible to rectify the drawbacks described above.

SUMMARY

To this end, one aspect of the invention relates to an electromagnetic actuator, in particular for an electrical switching unit, this electromagnetic actuator having:

- an armature carrying at least one coil;
- a ferromagnetic yoke configured to channel a magnetic flux created by the coil;
- a ferromagnetic moving part that interacts with the yoke to form a magnetic circuit, the magnetic circuit being formed at least in part by an assembly of laminated metal plates, the moving part being configured to move in relation to the armature under the action of the magnetic field generated by the coil;

wherein the actuator moreover has an auxiliary magnetic circuit made of electrically conductive material, in order to permit the flow of currents induced in the auxiliary magnetic circuit when a magnetic field is generated by the coil.

By virtue of the invention, the auxiliary magnetic circuit allows the induced currents to flow in the actuator when a magnetic field is generated, while these induced currents are not able to flow in other portions of the actuator, such as the magnetic circuit, which are formed by assemblies of laminated ferromagnetic plates.

The induced currents lead to a phase offset between the magnetic flux and the electric control current used to supply power to the coil, thereby generating an electromotive force visible on the voltage across the terminals of the coil.

This electromotive force may be used to implement diagnostic methods and/or methods for detecting the wear state or the operating state of the actuator.

The induced currents flowing in the auxiliary magnetic circuit nevertheless remain low enough not to impair the performance of the actuator, in particular not to lead to excessively high energy losses.

According to some advantageous but non-mandatory aspects, an electromagnetic actuator of this kind may incorporate one or more of the following features, taken alone or in any technically permissible combination:

- The auxiliary magnetic circuit is made of metal and has the shape of a closed contour in a geometrical plane perpendicular to a flow direction, in the magnetic circuit, of the magnetic flux generated by the coil.
- The auxiliary circuit has a metal piece attached to the armature of the actuator and surrounding the flow direction, in the magnetic circuit, of the magnetic flux generated by the coil.
- The metal piece is made of non-magnetic material.
- The auxiliary circuit has a layer of electrically conductive material formed on the surface of the armature of the actuator through a surface treatment method, the auxiliary circuit having the shape of a closed contour surrounding at least part of the magnetic circuit.
- The magnetic yoke has spreaders made of solid magnetic material, the auxiliary magnetic circuit being formed by the spreaders.
- The moving part is made of solid magnetic material and the magnetic yoke is formed completely by an assembly of laminated metal sheets, the auxiliary magnetic circuit being formed by the moving part.
- The auxiliary circuit has at least one metal piece surrounding an arm formed on an end of the moving part.
- The auxiliary circuit has a metal piece surrounding each of the end arms of the moving part.

According to another aspect, an electrical switching unit has an electromagnetic actuator as defined above.

BRIEF DESCRIPTION OF THE DRAWINGS

The invention will be better understood and other advantages thereof will become more clearly apparent in the light of the following description of one embodiment of an electromagnetic actuator, provided solely by way of example and with reference to the appended drawings, in which.

DETAILED DESCRIPTION

Figure 1:
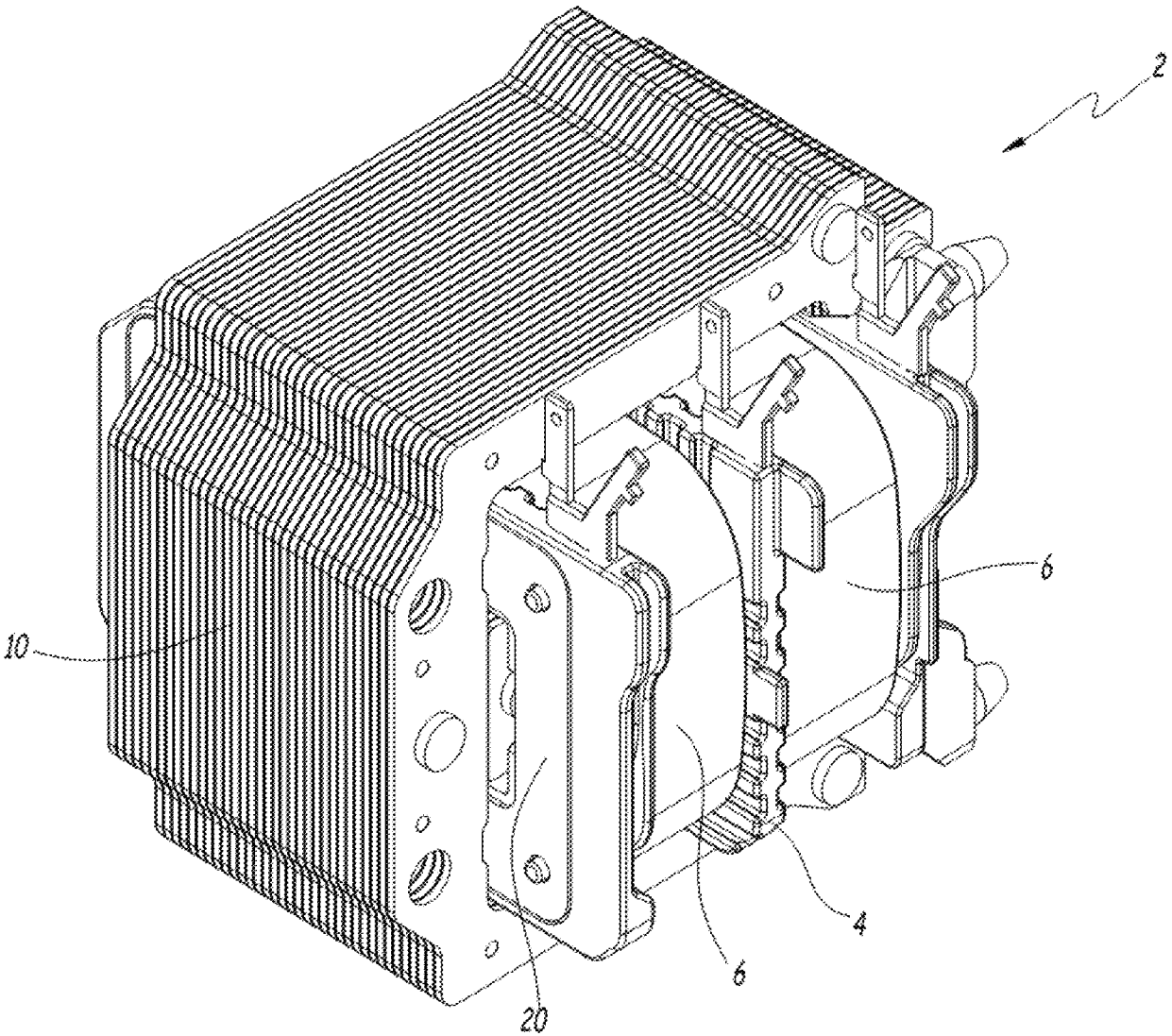
FIG. 1 schematically shows a perspective view of an electromagnetic actuator according to a first embodiment of the invention.
Figure 2:
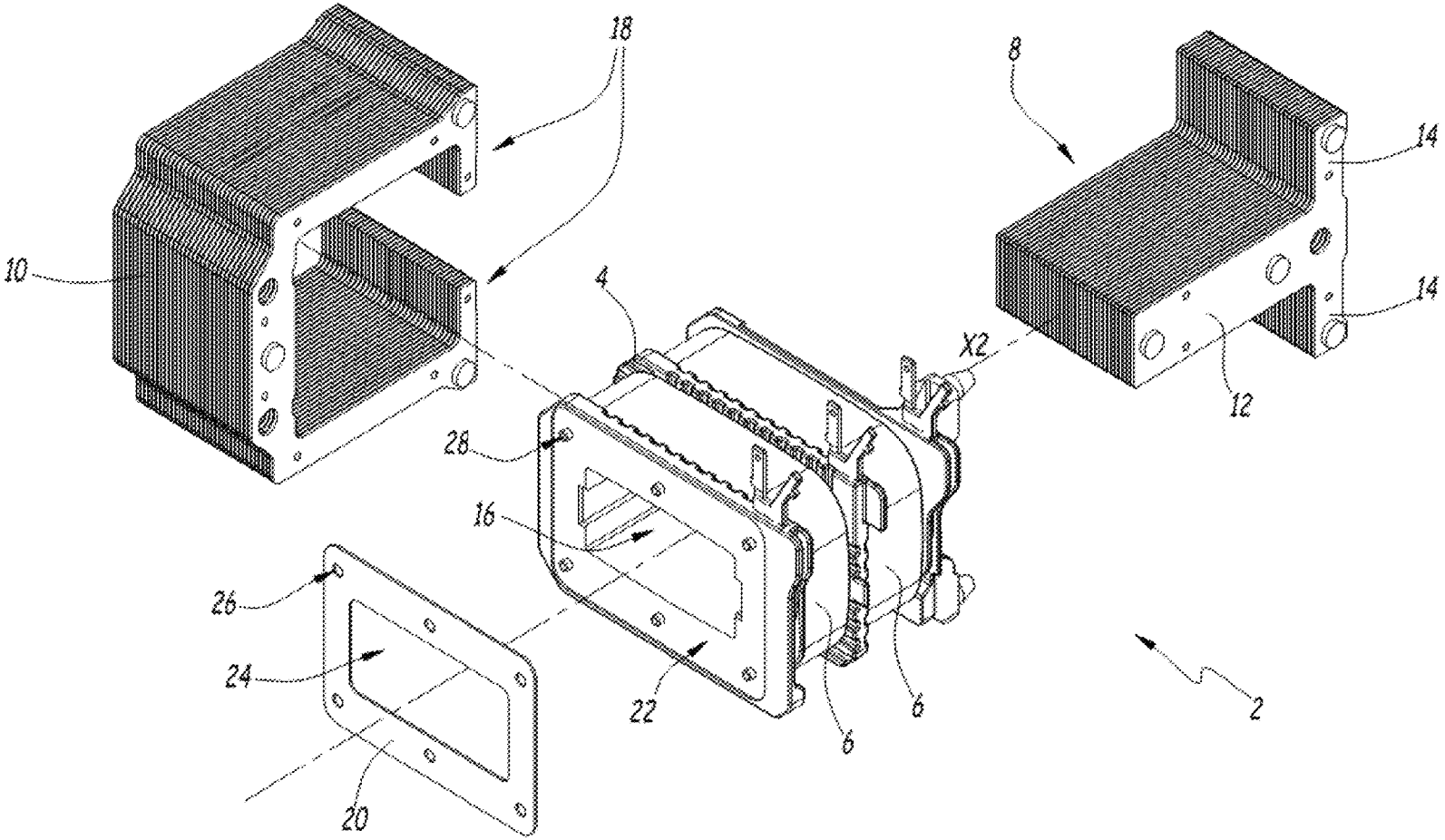
FIG. 2 schematically shows an exploded view of the electromagnetic actuator from FIG. 1.

FIGS. 1 and 2 show an electromagnetic actuator 2 according to some embodiments.

As may be seen more particularly in FIG. 2, the actuator 2 has an armature 4 carrying at least one coil 6, a moving part 8 and a ferromagnetic yoke 10 configured to channel a magnetic flux created by the coil 6.

Said at least one coil 6 is configured to generate a magnetic field along a longitudinal axis X2, which corresponds here to a direction of movement of the moving part 8.

In the example illustrated, two coils 6 are mounted on the armature 4 next to one another and are controlled jointly. In practice, several coils 6 may be used jointly to generate the magnetic field. As a variant, however, just one coil 6 may be used.

Each coil 6 here has a cylindrical shape having the axis X2 as central axis.

The coil or coils 6 are configured to be supplied with electric power by a control circuit, not illustrated, which may be external to the actuator 2.

According to some exemplary implementations, the armature 4 is made of an electrically insulating material, such as a polymer material, for example polyamide, or any suitable material.

The moving part 8 is designed to move with respect to the armature 4 under the action of the magnetic field created by the coil or coils 6.

The moving part 8 is in particular configured to move reversibly and selectively in translation between a retracted position and a deployed position with respect to the armature 4. In the example illustrated, this movement is performed through translation in the direction X2.

The moving part 8 interacts with the yoke 10 in order to form a magnetic circuit able to channel the magnetic flux created by the coil or coils 6.

For example, the moving part 8 and the yoke 10 are both made of a magnetic material, preferably a ferromagnetic material.

The yoke 10 is in particular formed at least in part by an assembly of laminated metal plates, or even formed in full by an assembly of laminated metal plates. The mobile part 8 is preferably also formed at least in part by an assembly of laminated metal plates, or even formed in full by an assembly of laminated metal plates.

For example, as illustrated in FIGS. 1 and 2, the metal plates, or sheets, are stacked within the assembly along a direction perpendicular to the axis X2.

In addition, the moving part 8 and the yoke 10 have complementary shapes, which allow loopback of the magnetic flux created by the coil or coils 6.

For example, the moving part 8 has a "T" shape and comprises a bar-shaped elongate central portion 12 that extends along the axis X2. The central portion 12 here has a rectangular cross section, this cross section being defined in a transverse plane perpendicular to the axis X2.

The moving part 8 also comprises arms 14, for example two arms 14, arranged at the distal end of the central portion 12 and extending perpendicular to the central portion 12.

The armature 4 here comprises a central orifice 16 that extends along the axis X2 and that is surrounded by the coil or coils 6. Thus, when a magnetic field is generated by the coil or coils 6, a corresponding magnetic flux flows along the central part 12.

The central part 12 is received inside the central orifice 16 and slides along the central orifice 16 when the moving part 8 moves in translation.

The yoke 10 for its part has a closed shape with a C-shaped profile, the upper and lower faces of which are parallel here to the axis X2. The yoke 10 defines a central cavity inside which the armature 4 is housed.

The distal ends of the upper and lower faces of the yoke 10 here have spreaders 18, which are in the form of folded edges of the upper and lower faces of the yoke 10.

When the actuator 2 is in an assembled configuration, as is the case in FIG. 1, the spreaders 18 are arranged facing the arms 14 of the moving part 8. The spreaders 18 make it easier to loop the magnetic flux back between the yoke 10 and the moving part 8.

Depending on whether the moving part 8 is in its retracted or deployed position, the arms 14 are respectively in contact with the spreaders 18 or, by contrast, spaced from the spreaders 18.

The arms 14 make it easier to loop the magnetic flux back between the moving part 8 and the yoke 10 in the magnetic circuit, even when the spreaders 18 are omitted.

The operation of such electromagnetic actuators is known and is not described in more detail.

Generally speaking, the actuator 2 may be used in an electrical switching unit, such as a contactor, or a relay, or a remote-controlled switch, or an electrical protection unit or the like.

For example, an electrical switching unit has one or more separable electrical contacts that are able to be moved between open and closed states in order to selectively interrupt or allow the flow of an electric current.

In this case, the actuator 2 may be coupled to the mobile contacts of the switching unit, for example in order to move them directly, or be coupled to a switching mechanism associated with the switching unit and configured to move the contacts when it is triggered by the actuator. For example, the moving part 8 is coupled to a lever for actuating the switching mechanism.

As a variant, different types of electrical unit may incorporate an actuator 2 of this kind.

Advantageously, a diagnostic method, and/or a method for estimating the wear state or the operating state of the actuator, for example as described in patent application EP2584575 B1, is implemented by a diagnostic device associated with an electrical unit or actuator 2 of this kind. Other diagnostic and/or monitoring methods may be used as a variant.

According to numerous embodiments of the invention, the actuator 2 furthermore has an auxiliary magnetic circuit 20 made of electrically conductive material.

The auxiliary magnetic circuit 20 is configured to permit the flow of currents induced within it when a magnetic field is created by the coil 6.

The induced currents are for example eddy currents.

In numerous examples, the auxiliary circuit 20 has the shape of a ring, or more generally the shape of a closed contour, which surrounds at least part of the magnetic flux generated by the coil or coils 6 and flowing in the magnetic circuit formed by the combination of the moving part 8 and the yoke 10.

In practice, the auxiliary circuit 20 is therefore arranged so as to surround at least part of the magnetic circuit formed by the combination of the moving part 8 and the yoke 10. For example, the auxiliary circuit 20 surrounds a cross section of at least part of said magnetic circuit.

For example, the auxiliary circuit 20 directly surrounds the central part 12 of the moving part 8, or surrounds the central orifice 16 of the armature 4 (and in fact at least partially surrounds the central part 12).

For example, "in the shape of a ring" here denotes a closed contour defined by the auxiliary circuit 20, which may have a circular shape, or an essentially circular, or elliptical, or square, or rectangular, or polygonal shape or any appropriate shape for permitting the flow and the loopback of a loop of electric current induced when a magnetic field is generated by the coil or coils 6 when arranged around the magnetic flux generated by the coil or coils 6.

For example, the auxiliary circuit 20 defines a closed contour in a geometrical plane perpendicular or essentially perpendicular to the axis X2, or more generally in a geometrical plane perpendicular or essentially perpendicular to the direction of the magnetic flux flowing in the magnetic circuit formed by the moving piece 8 and by the yoke 10.

According to one preferred embodiment, one exemplary implementation of which is illustrated in FIGS. 1 and 2, the auxiliary circuit 20 comprises a metal piece, such as a hollowed metal plate, mounted on the armature 4, for example mounted on a front face 22 of the armature 4.

This hollowed plate thus has the shape of a ring. As a variant, the metal piece may be an electrical conductor folded back on itself, such as a wire or a metal strip folded back on itself or a short-circuited coil.

In other words, the metal piece is separate from the magnetic circuit formed by the combination of the moving part 8 and the yoke 10.

Other locations are nevertheless possible for fastening said metal piece to the armature 4, such as for example on a rear face, or on the peripheral perimeter of a central part of the armature 4. In this last case, the metal piece may be placed on a portion of the armature 4 separating two coils 6, or inside the armature 4 under one of the coils 6, an electrically insulating element then being able to be inserted between the coil 6 and said metal piece.

In the example illustrated, the metal plate forming the auxiliary circuit 20 comprises a central orifice 24 intended to be aligned with the central orifice 16 of the armature 4.

Said metal piece may be fastened to the armature 4 by way of dedicated fastening elements, or by adhesive bonding, or by welding, or by any suitable means.

For example, apertures 26 are formed at several locations of the metal piece. Each aperture 26 is configured to interact with a corresponding fastening pad 28 formed on the armature.

Optionally, as in the example visible in FIG. 2, the front face 22 of the armature 4 may have a recess, or groove, forming a receptacle for receiving the metal piece forming the auxiliary circuit 20, and in which the fastening pads 28 are formed.

By virtue of the invention, the auxiliary magnetic circuit 20 allows the induced currents to flow in the actuator when a magnetic field is generated by the coil 6, while these induced currents are not able to flow in other portions of the actuator, such as the magnetic circuit, which are formed by assemblies of laminated ferromagnetic plates.

The induced currents lead to a phase offset between the magnetic flux generated by the coil 6 and the electric control current used to supply power to the coil 6, thereby generating an electromotive force visible on the voltage across the terminals of the coil 6.

This electromotive force may be used to implement diagnostic methods and/or methods for detecting the wear state or the operating state of the actuator, for example those described by patent application EP 2584575 B1, or with other methods being able to be used as a variant.

The induced currents flowing in the auxiliary magnetic circuit 20 nevertheless remain low enough not to impair the performance of the actuator 2, in particular not to lead to excessively high energy losses.

The invention therefore makes it possible to obtain an electromagnetic actuator that is robust and inexpensive to manufacture, and which is compatible with diagnostic and/or monitoring and/or state detection methods.

Advantageously, the material forming the auxiliary circuit 20 is a non-magnetic metal, such as copper, or aluminium, or any suitable material or alloy, preferably a metal having a low resistivity.

For example, a metal the coefficient of thermal variation of the electrical resistivity of which is less than or equal to 0.005 $K^{-1}$ will preferably be chosen.

Using a non-magnetic material makes it possible to reduce variations in skin thickness when induced currents are generated and flow in the auxiliary circuit 20, thereby ultimately making it possible to reduce or even eliminate the variations in equivalent resistance of the auxiliary circuit 20.

Thus, in the case of diagnostic or monitoring or state detection methods based on measuring the electromotive force generated across the terminals of the coil 6 by virtue of such induced currents, such as the methods outlined above, the results are easier to interpret, since the component of this electromotive force linked to the equivalent resistance of the auxiliary circuit 20 remains constant for the time scales under consideration.

Such a diagnostic and/or monitoring and/or state detection method is therefore easier to implement and gives more reliable results than if induced currents flow in a solid magnetic material.

As a variant, however, the conductive material forming the auxiliary circuit 20 may be a magnetic metal, such as a ferromagnetic metal.

Numerous other embodiments are possible, some of which will now be described.

It will be understood that each of the embodiments described below may differ from the embodiments of the actuator 2 described above by the way in which the auxiliary magnetic circuit 20 is implemented, but that the role and the general operation of the auxiliary magnetic circuit 20, as well as the nature of the materials used to form the auxiliary magnetic circuit 20, are similar to those described above with reference to the actuator 2.

Thus, according to some alternative embodiments, not illustrated, the auxiliary circuit 20 may be placed elsewhere than on the armature 4, while still nevertheless being placed so as to surround at least part of the magnetic flux generated by the coil 6.

The auxiliary magnetic circuit 20 may also be produced other than by way of an attached magnetic piece.

Figure 3:
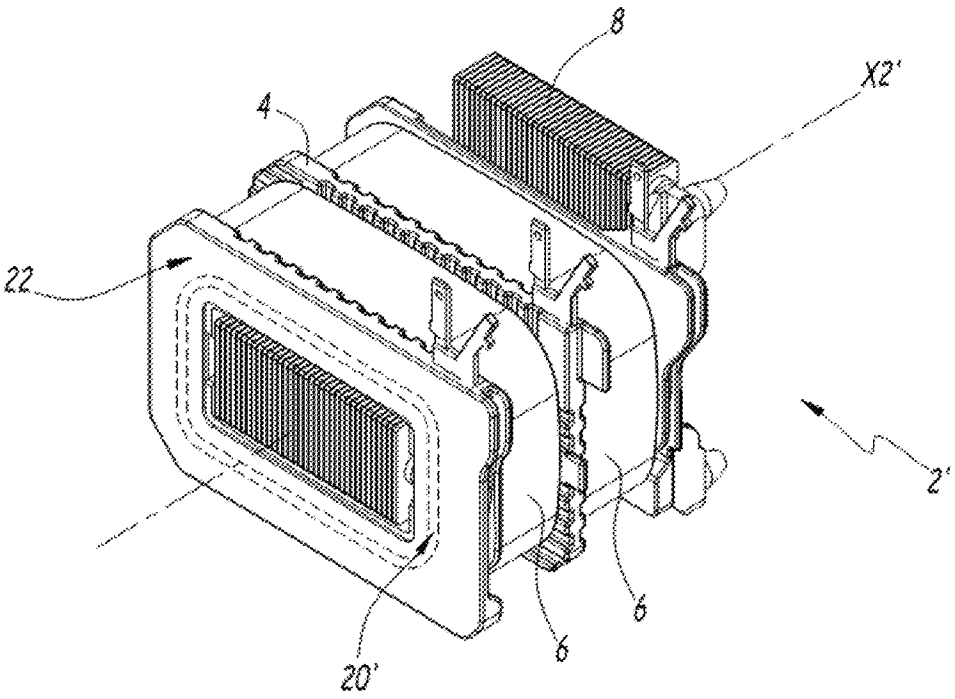
FIG. 3 schematically shows a perspective view of part of an electromagnetic actuator according to a second embodiment of the invention.

According to a first example, in particular illustrated with reference to FIG. 3, an electromagnetic actuator 2', the operation of which is analogous to the actuator 2 described above, comprises an auxiliary magnetic circuit 20' that has a layer of an electrically conductive material formed on the surface of the armature through a surface treatment method, such as autocatalytic or electrochemical deposition of a metal such as nickel or tin. For example, this layer is formed here on the face 22.

As above, the auxiliary circuit 20' has the shape of a closed contour surrounding the magnetic flux generated by the coil 6.

Figure 4:
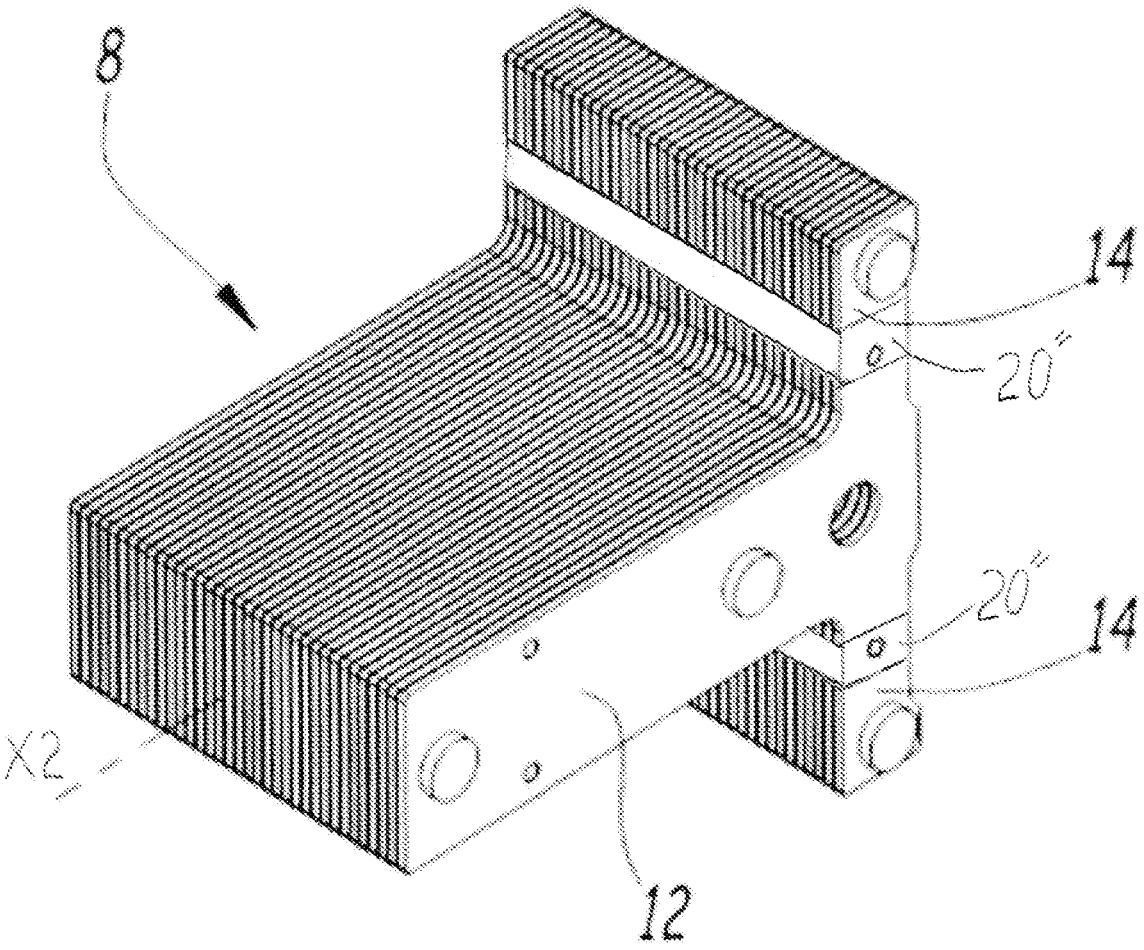
FIG. 4 schematically shows a perspective view of a moving part of an electromagnetic actuator according to one embodiment of the invention.

According to a second example, not illustrated, the auxiliary circuit 20 has at least one metal piece surrounding one of the end arms 14 of the moving part 8, as illustrated by 20" in FIG. 4. The metal part is for example as described above with reference to the actuator 2.

In this second example, the closed contour of the auxiliary circuit does not extend about the axis X2, since the arm 14 (and therefore the magnetic flux channelled by the magnetic circuit) is perpendicular here to the axis X2.

Preferably, in this second example, two such metal pieces are used, each one surrounding one of the two arms 14 of the moving part 8, so as to form two auxiliary circuits, as illustrated in FIG. 4.

Specifically, at the arms 14, the magnetic flux is divided into two, half of the magnetic flux passing into each of the two arms 14. By placing an auxiliary circuit around each arm 14, a phase offset is nevertheless obtained, for the whole actuator 2, which is similar to the case in which a single auxiliary circuit would be placed around the central part 12.

Other embodiments may be implemented when at least part of the yoke 10 or of the moving part 8 is not formed completely by an assembly of laminated metal plates, for example when at least one or the other of them is made at least partially of solid ferromagnetic material.

In one example, not illustrated, the moving part 8 is made of solid magnetic material and the yoke 10 is formed entirely by an assembly of laminated metal plates. The auxiliary magnetic circuit is then formed by the moving part 8, in which the induced currents are able to flow freely, since this moving part 8 is then made of solid ferromagnetic material.

According to another example, not illustrated, the yoke 10 is made of solid magnetic material and the moving part 8 is formed entirely by an assembly of laminated metal plates. The auxiliary magnetic circuit is then formed by the yoke 10, in which the induced currents are able to flow freely, since it is then made of solid ferromagnetic material.

According to yet another example, the spreaders 18 of the yoke 10 are made of solid magnetic material, the rest of the yoke 10 being formed by an assembly of laminated metal plates.

The auxiliary magnetic circuit is then formed by the spreaders 18, in which the induced currents are able to flow freely, since the spreaders 18 are made of solid ferromagnetic material.

Any feature of one of the embodiments or variants described above may be implemented in the other described embodiments and variants.

The invention claimed is:

1. An electromagnetic actuator for an electrical switching unit, the electromagnetic actuator comprising:

an armature carrying at least one coil, the armature including an orifice that extends along an axis and is surrounded by the at least one coil configured to generate a magnetic field along the axis;

a ferromagnetic yoke configured to channel a magnetic flux created by the coil, the yoke defining a cavity for housing at least the armature; and a ferromagnetic moving part that interacts with the yoke to form a magnetic circuit, the magnetic circuit being formed at least in part by an assembly of laminated metal plates, the moving part being configured to move in relation to the armature under the action of the magnetic field generated by the coil, the moving part having a portion which is received in the orifice and slides along the axis when the moving part moves in translation, wherein the electromagnetic actuator further comprises an auxiliary magnetic circuit made of electrically conductive material, in order to permit the flow of currents induced in the auxiliary magnetic circuit when a magnetic field is generated by the coil.

2. The actuator according to claim 1, wherein the auxiliary magnetic circuit is made of metal and has the shape of a closed contour in a geometrical plane perpendicular to a flow direction, in the magnetic circuit, of the magnetic flux generated by the coil.

3. The actuator according to claim 1, wherein the auxiliary magnetic circuit has a metal piece attached to the armature of the actuator and surrounding the flow direction, in the magnetic circuit, of the magnetic flux generated by the coil.

4. The actuator according to claim 3, wherein the metal piece is made of non-magnetic material.

5. The actuator according to claim 1, wherein the auxiliary magnetic circuit has a layer of electrically conductive material formed on the surface of the armature of the actuator through a surface treatment method, the auxiliary magnetic circuit having the shape of a closed contour surrounding at least part of the magnetic circuit.

6. An electromagnetic actuator according to claim 1, wherein the yoke has spreaders made of solid ferromagnetic material, the spreaders forming an auxiliary magnetic circuit that permits a flow of currents induced in the auxiliary magnetic circuit when a magnetic field is generated by the coil.

7. An electromagnetic actuator according to claim 1, wherein the moving part is made of solid ferromagnetic material and the magnetic yoke is formed entirely of an assembly of laminated metal plates, the moving part forming an auxiliary magnetic circuit made of electrically conductive material that permits a flow of currents induced in the auxiliary magnetic circuit when a magnetic field is generated by the coil.

8. The actuator according to claim 1, wherein the auxiliary magnetic circuit has at least one metal piece surrounding an arm formed on an end of the moving part.

9. The actuator according to claim 8, wherein the auxiliary magnet circuit has a metal piece surrounding each of the end arms of the moving part.

10. An electrical switching unit, comprising an electromagnetic actuator according to claim 1.

11. The actuator according to claim 1, wherein at least a portion of the electrically conductive material of the auxiliary magnetic circuit is arranged in the cavity of the yoke when the magnetic circuit is formed by the interaction of the ferromagnetic yoke and the ferromagnetic moving part.

12. The actuator according to claim 1, wherein at least a portion of the electrically conductive material of the auxiliary magnetic circuit is arranged between the yoke and the moving part when the magnetic circuit is formed by the interaction of the ferromagnetic yoke and the ferromagnetic moving part.

13. The actuator according to claim 1, wherein the armature is made of an electrically insulating material.

14. The actuator according to claim 1, wherein the yoke comprises at least a portion made of an assembly of laminated metal plates, within which is housed the armature carrying the at least one coil.

15. The actuator according to claim 1, wherein the auxiliary magnetic circuit surrounds part of the magnetic flux flowing along only one flow path of the magnetic circuit.

* * * * *